US005347679A

United States Patent [19]

Saunders et al.

[11] Patent Number: 5,347,679

[45] Date of Patent: Sep. 20, 1994

[54] STICK TYPE VACUUM CLEANER

[75] Inventors: Craig M. Saunders, Rocky River; Paul D. Stephens, Cleveland Heights; Michael F. Wright, Cuyahoga Falls, all of Ohio

[73] Assignee: Royal Appliance Mfg. Co., Cleveland, Ohio

[21] Appl. No.: 1,458

[22] Filed: Jan. 7, 1993

[51] Int. Cl.[5] ..... A47L 9/02

[52] U.S. Cl. ..... 15/416; 15/329; 15/414; 15/420; 15/374

[58] Field of Search ..... 15/329, 335, 344, 347, 15/360, 414, 416, 420, 374, 345

[56] References Cited

U.S. PATENT DOCUMENTS

| | | | |
|---|---|---|---|
| D. 172,300 | 10/1953 | Penzato . | |
| D. 177,274 | 3/1956 | Patterson . | |
| D. 194,025 | 11/1962 | Gantz . | |
| D. 203,968 | 3/1966 | Lagerstrom . | |
| D. 228,608 | 10/1973 | Johnson . | |
| D. 280,033 | 8/1985 | Miyamoto et al. . | |
| D. 290,895 | 7/1987 | Thomas et al. . | |
| D. 292,636 | 11/1987 | Goodrich et al. . | |
| 1,072,607 | 9/1913 | Guthorn . | |
| 1,156,235 | 10/1915 | Kirby . | |
| 1,533,368 | 4/1925 | Berg . | |
| 1,639,959 | 8/1927 | Owen | 15/414 |
| 1,699,598 | 1/1929 | Lee . | |
| 1,708,194 | 4/1929 | Smidley . | |
| 1,725,762 | 8/1929 | Lee . | |
| 1,785,675 | 12/1930 | Cundiff . | |
| 1,826,798 | 10/1931 | Lee . | |
| 1,867,284 | 7/1932 | Smidley . | |
| 2,203,088 | 6/1940 | Hansson . | |
| 2,235,225 | 3/1941 | Ross . | |
| 2,519,741 | 8/1945 | Caughey . | |
| 2,624,063 | 1/1953 | Van der Heem | 15/416 |
| 2,658,228 | 11/1953 | Meyerhoefer . | |
| 2,668,763 | 8/1954 | Pfaffle et al. . | |
| 2,747,217 | 10/1956 | Stahl . | |
| 2,876,481 | 3/1959 | Gerber et al. . | |
| 3,013,294 | 12/1961 | Ostrom . | |
| 3,040,364 | 6/1962 | Carlberg | 15/416 |
| 3,273,187 | 9/1966 | Williams . | |
| 3,319,278 | 5/1967 | Frazer . | |
| 3,360,816 | 1/1968 | Fontecchio . | |
| 3,530,527 | 9/1970 | Dubbelman et al. | 15/344 |
| 3,667,084 | 6/1972 | Valbona et al. | 15/329 |
| 4,037,290 | 7/1977 | Rose et al. | 15/345 |
| 4,336,628 | 6/1982 | Bradshaw et al. . | |
| 4,458,378 | 7/1984 | Helmes | 15/420 |
| 4,638,526 | 1/1987 | Murata et al. . | |
| 4,638,527 | 1/1987 | Fleischhauer | 15/374 |
| 4,715,084 | 12/1987 | Jacob et al. . | |
| 4,876,763 | 10/1989 | Cho et al. | 15/329 |
| 5,107,567 | 4/1992 | Ferrari et al. . | |

FOREIGN PATENT DOCUMENTS

| | | |
|---|---|---|
| 3214682A1 | 10/1983 | Fed. Rep. of Germany . |

*Primary Examiner*—Timothy F. Simone
*Assistant Examiner*—James F. Hook
*Attorney, Agent, or Firm*—Fay, Sharpe, Beall, Fagan, Minnich & McKee

[57] ABSTRACT

A portable stick-type vacuum cleaner includes an elongated housing and a substantially triangular nozzle which is selectively securable to the housing. The nozzle includes a nozzle body having a bottom surface and a top surface. A V-shaped suction opening is located on the bottom surface of the nozzle body. The nozzle body also has a plurality of casters located on its bottom surface. An air outlet member is in fluid connection with the suction opening. The air outlet member includes a sleeve pivotally mounted to the top surface of the nozzle body and a coupling for selective fluid connection with the housing. The coupling is rotatably mounted on the sleeve. A motor is mounted in the housing for effecting a suction of air through the nozzle.

27 Claims, 7 Drawing Sheets

STICK TYPE VACUUM CLEANER

BACKGROUND OF THE INVENTION

The invention relates to vacuum cleaners. More particularly, the present invention relates to small portable lightweight vacuum cleaners adapted to be hand carried.

The invention is particularly adapted for use with an elongated stick-type or broom-type vacuum cleaner. However, it should be appreciated by those of average skill in the art that the invention could also be utilized on a variety of other types of vacuum cleaner products.

Elongated stick or broom-type vacuum cleaners generally comprise an upstanding dust collecting assembly having a nozzle mounted on the lower end thereof. The nozzle generally comprises a housing which is rotatable in relation to the dust collecting assembly so that the dust collecting assembly can be manipulated relative to the nozzle. In this way, the nozzle can be moved under or around furniture in confined spaces and the like.

The ease of manipulation and maneuverability afforded by stick type vacuum cleaners has resulted in widespread use of such products. However, with conventional stick type vacuum cleaners, certain problems were faced either from the standpoint of efficiency in cleaning or from the standpoint of expense of manufacture. One problem has been that the nozzles of such stick vacuums could not successfully clean corners. Another problem has been the difficulty of pushing the nozzle back and forth on a carpeted surface.

Accordingly, it is desirable to develop a new and improved stick type vacuum cleaner which would overcome the foregoing difficulties and others while providing better and more advantageous overall results.

BRIEF SUMMARY OF THE INVENTION

According to the present invention, a new and improved nozzle for a vacuum cleaner is provided.

More particularly in accordance with this aspect of the invention, the nozzle comprises a housing having a bottom surface, a top surface and a V-shaped suction opening located on the bottom surface of the housing. A plurality of casters is also located on the bottom surface of the housing. An air outlet pivot assembly is in fluid connection with the suction opening. The air outlet pivot assembly comprises a first tubular section pivotally mounted to the top surface of the housing and a second tubular section rotatably mounted on the first section for selective fluid connection with a housing of the vacuum cleaner.

Preferably, three casters are located in a triangularly spaced manner on the bottom surface of the nozzle and the nozzle is also substantially triangular in shape. The bottom surface may include a plurality of spaced indented sections in which each of the plurality of casters is located in order to reduce the overall height of the nozzle.

In accordance with another aspect of the invention, a portable vacuum cleaner is provided.

More particularly in accordance with this aspect of the invention, the vacuum cleaner comprises a housing and a substantially triangular nozzle which is selectively securable to the housing. The nozzle comprises a nozzle body having a bottom surface and a top surface and a V-shaped suction opening located on the bottom surface of the nozzle body. An air outlet member is in fluid connection with the suction opening. The air outlet member comprises a first tubular section pivotally mounted to the top surface of the nozzle body and a second tubular section rotatably mounted on the first section wherein the second section can be selectively brought into fluid connection with the housing. A motor is mounted in the housing for effecting a suction of the air through the nozzle.

Preferably, a first handle is detachably connected to the housing. In addition, an extension member can be detachably connected between the first handle and the housing. The extension member can be selectively detached from its location between the handle and the housing and secured between the nozzle and the housing. In addition, a second handle is preferably located on the vacuum cleaner housing in a manner spaced from the first handle.

In accordance with still another embodiment of the invention, a vacuum cleaner which is convertible between an upright vacuum cleaner and a portable hand carried vacuum cleaner is provided.

More particularly in accordance with this aspect of the invention, the vacuum cleaner comprises a housing for vacuum components, the housing including first and second ends. The vacuum components comprise a suction stub located at the first end of the housing, a motor and a motor driven fan for effecting the suction of air through the suction stub and a filter means for receiving air from the vacuum nozzle opening and arranged to remove and collect dirt from the air. A first handle means is mounted on the second end of the housing. The handle means comprises an extension pipe selectively mounted at a first end to the housing second end and a handle member which is selectively mounted on a second end of the extension pipe wherein the handle member can be mounted directly to the housing second end when the extension pipe is removed. A second handle means is located on the housing between the first and second ends thereof.

Preferably, the filter means comprises a selectively removable and replaceable filter bag. In the preferred embodiment of the invention, the vacuum cleaner further comprises a nozzle which is selectively securable to the housing. The nozzle can comprise a nozzle housing having a bottom surface and a top surface, a V-shaped suction opening being located on the bottom surface of the nozzle housing, and an air outlet member being in fluid connection with the suction opening. The air outlet member can comprise a sleeve pivotally mounted to the top surface of the housing.

Also preferably provided is a coupling for selective fluid connection with the housing, the coupling being mounted on the sleeve. The coupling can comprise a T-shaped member having a stem fixedly mounted to the housing suction stub and a barrel disposed at right angles to the stem with the barrel being rotatably mounted to the nozzle housing.

One advantage of the present invention is the provision of a new and improved vacuum cleaner.

Another advantage of the present invention is the provision of a vacuum cleaner having a selectively detachable nozzle which is V-shaped and has a V-shaped suction opening on its bottom surface. This enables the nozzle to successfully clean corners, baseboards and the like.

Still another advantage of the present invention is the provision of a vacuum cleaner having a nozzle which is rotatably supported on a plurality of casters. The casters can be swiveling if desired. This enables the nozzle to be smoothly moved in any direction over both carpeted and non-carpeted surfaces. Preferably, three such casters are provided in a triangular relationship on the bottom surface of a triangular nozzle.

Yet another advantage of the present invention is the provision of a stick type vacuum cleaner which has a selectively detachable hollow handle extension member. This member can be selectively secured between the handle and the housing or can be secured to a suction stem of the housing so as to extend the reach of the vacuum cleaner when it is used in a hand held manner for vacuuming, e.g. curtains, ceiling corners for cobwebs and the like.

Yet still another advantage of the present invention is the provision of a stick type vacuum cleaner which has a double pivoting system for a nozzle so as to provide the nozzle with 2 degrees of freedom.

A further advantage of the present invention is the provision of a stick type vacuum cleaner which has two separate handle means. A top handle is useful when the stick type vacuum cleaner is used for on-the-floor cleaning. Both handles can be utilized when the stick type vacuum cleaner is lifted for cleaning above-the-floor articles such as couches, curtains and the like.

A still further advantage of the present invention is the provision of a stick type vacuum cleaner having a nozzle that has a stepped front surface along its bottom face. This improves the air flow into the unit and also helps to reduce the effort needed to push the nozzle over carpeted surfaces.

A yet further advantage of the present invention is the provision of a stick type vacuum cleaner having a nozzle with an elongated opening, preferably in the shape of a V. Each leg of the nozzle opening has an inner section which is directly open to a hollow interior of the nozzle and a second outer section defined by a sloping upper surface. The sloping surface increases the velocity of air being sucked in from the end of the outer section toward the hollow nozzle interior thereby increasing the overall cleaning efficiency of the nozzle.

An additional advantage of the present invention is the provision of a stick type vacuum cleaner with a suction stub to which one can attach tools, a hose or a nozzle as desired.

Still other benefits and advantages of the invention will become apparent to those skilled in the art upon a reading and understanding of the following detailed specification.

BRIEF DESCRIPTION OF THE DRAWINGS

The invention may take form in certain components and structures a preferred embodiment of which will be described in detail in this specification and illustrated in the accompanying drawings wherein.

DETAILED DESCRIPTION OF THE PREFERRED EMBODIMENT

Figure 6:
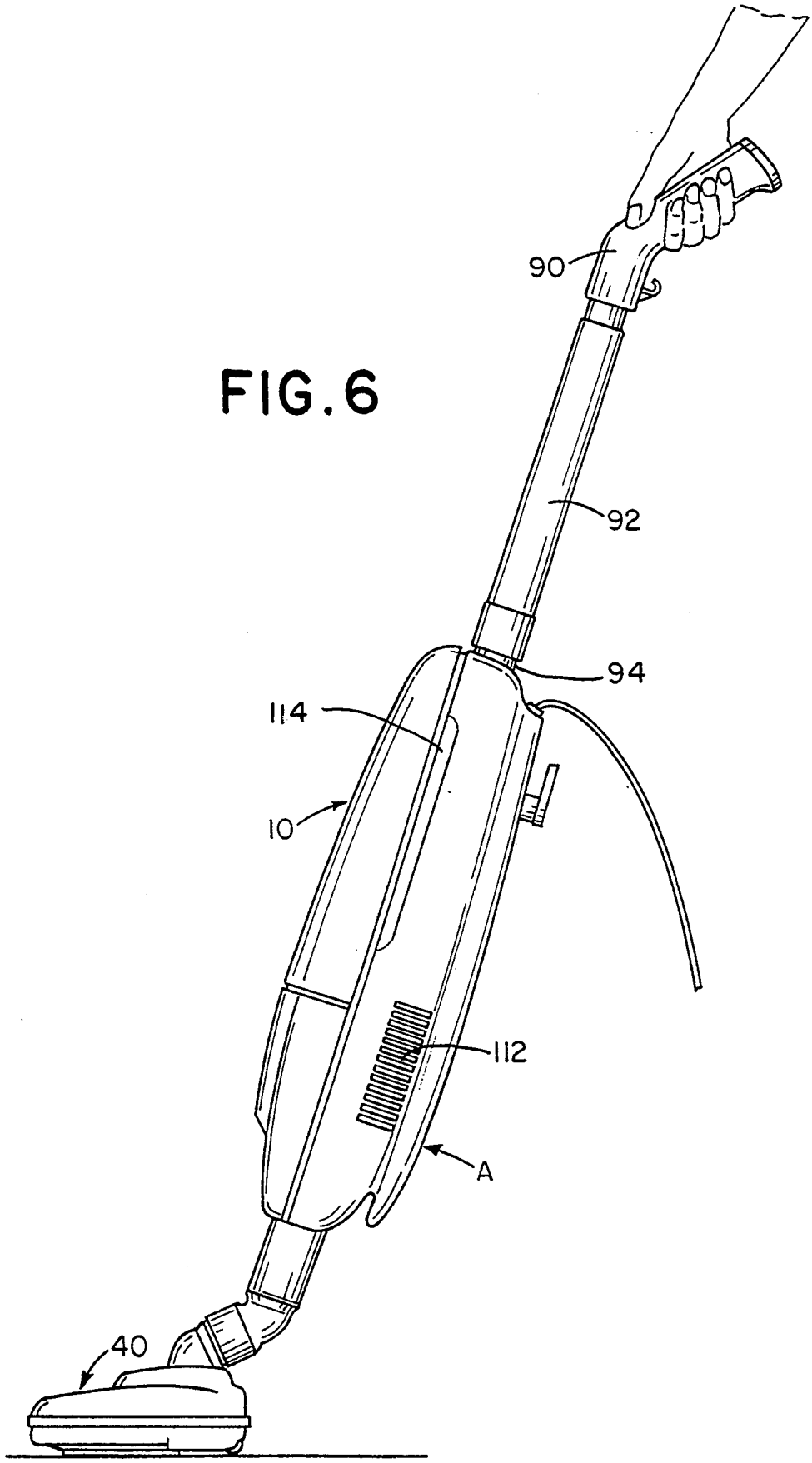
FIG. 6 is a side elevational view of the vacuum cleaner of FIG. 1 in an assembled condition as used for on-the-floor cleaning.
Figure 7:
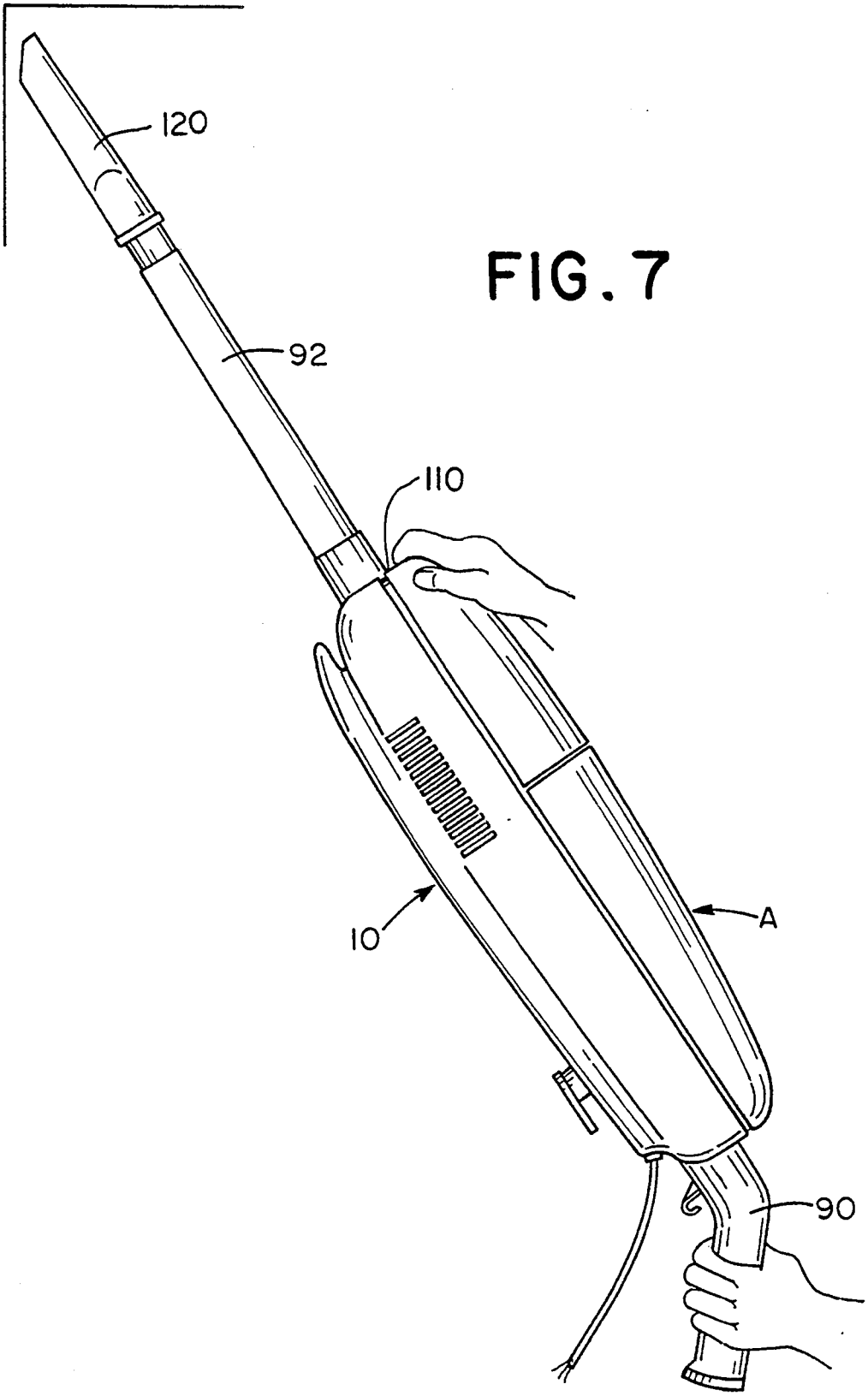
FIG. 7 is a side elevational view of the vacuum cleaner of FIG. 1 in an assembled condition as used for above-the-floor cleaning; and, FIG. 8 is an enlarged cross-sectional view through one linear suction opening of the nozzle of FIG. 2.

Referring now to the drawings, wherein the showings are for purposes of illustrating a preferred embodiment of the invention only and not for purposes of limiting same, FIG. 6 shows a stick type vacuum cleaner A as it is used for on-the-floor cleaning whereas FIG. 7 illustrates the vacuum cleaner when it has been reconfigured for use in off-the-floor cleaning. While the invention is primarily designed for and will hereinafter be described in connection with a stick type vacuum cleaner or broom type vacuum cleaner, it should be appreciated by those of average skill in the art that the invention could also be applied to various other types of vacuum cleaners.

Figure 1:
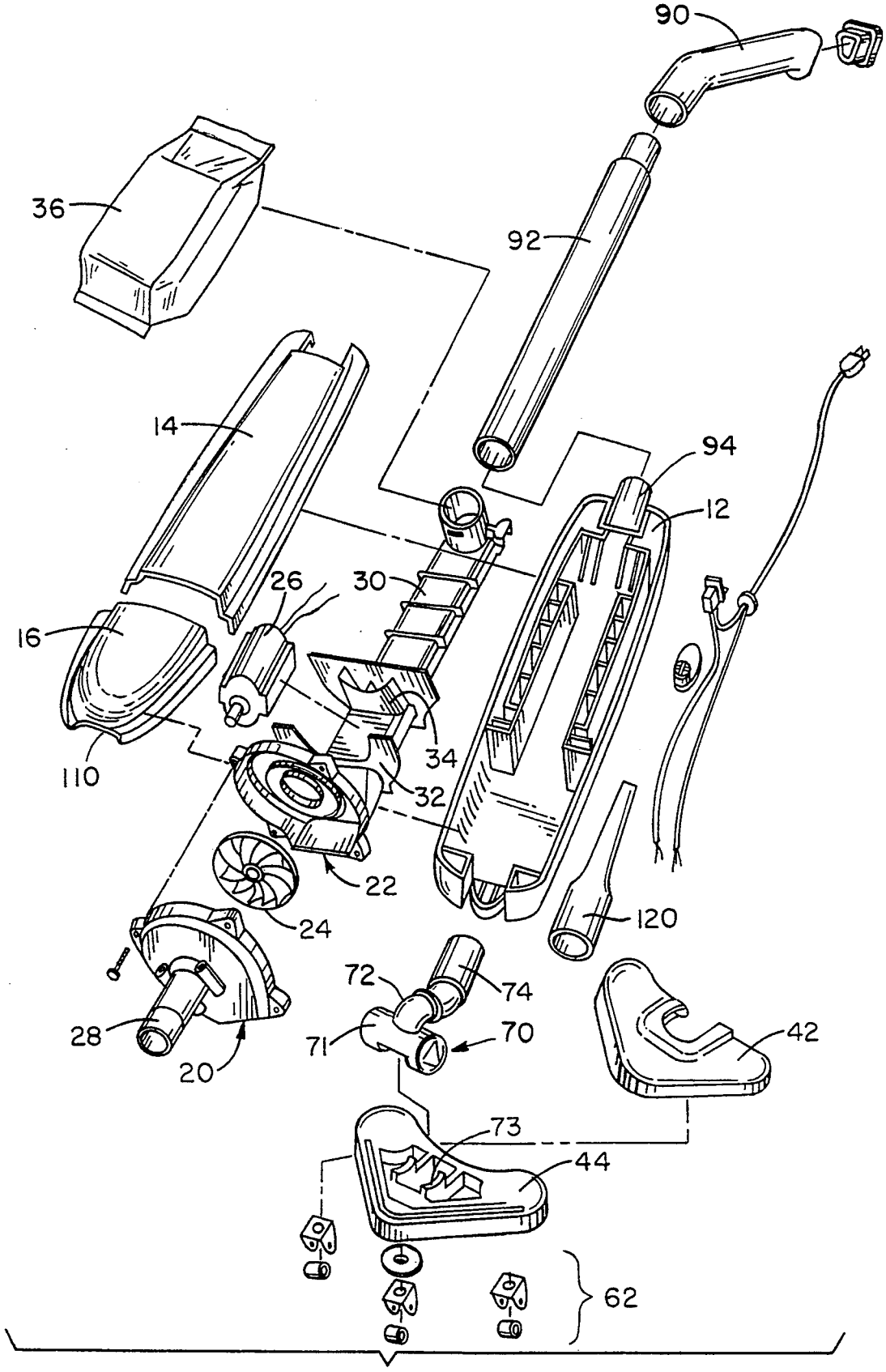
FIG. 1 is an exploded perspective view of the vacuum cleaner according to the present invention.

FIG. 6 illustrates that the vacuum cleaner A comprises an elongated housing 10. With reference now also to FIG. 1, the housing 10 comprises a back housing half 12, a front housing half upper section or panel 14 and a front housing half lower section or motor cover 16. These are all secured together by conventional means.

Also provided is a fan shell first half 20 and a fan shell second half 22 which cooperate to together enclose a suction fan 24 powered by a motor 26. The fan shell first half 20 includes an integral suction stub 28. The fan shell second half 22 includes an integral air tube 30 and a pair of motor mounts 32, 34 for supporting the motor 26. The air tube 30 leads to a filter bag 36 that is positioned in the housing.

Figure 2:
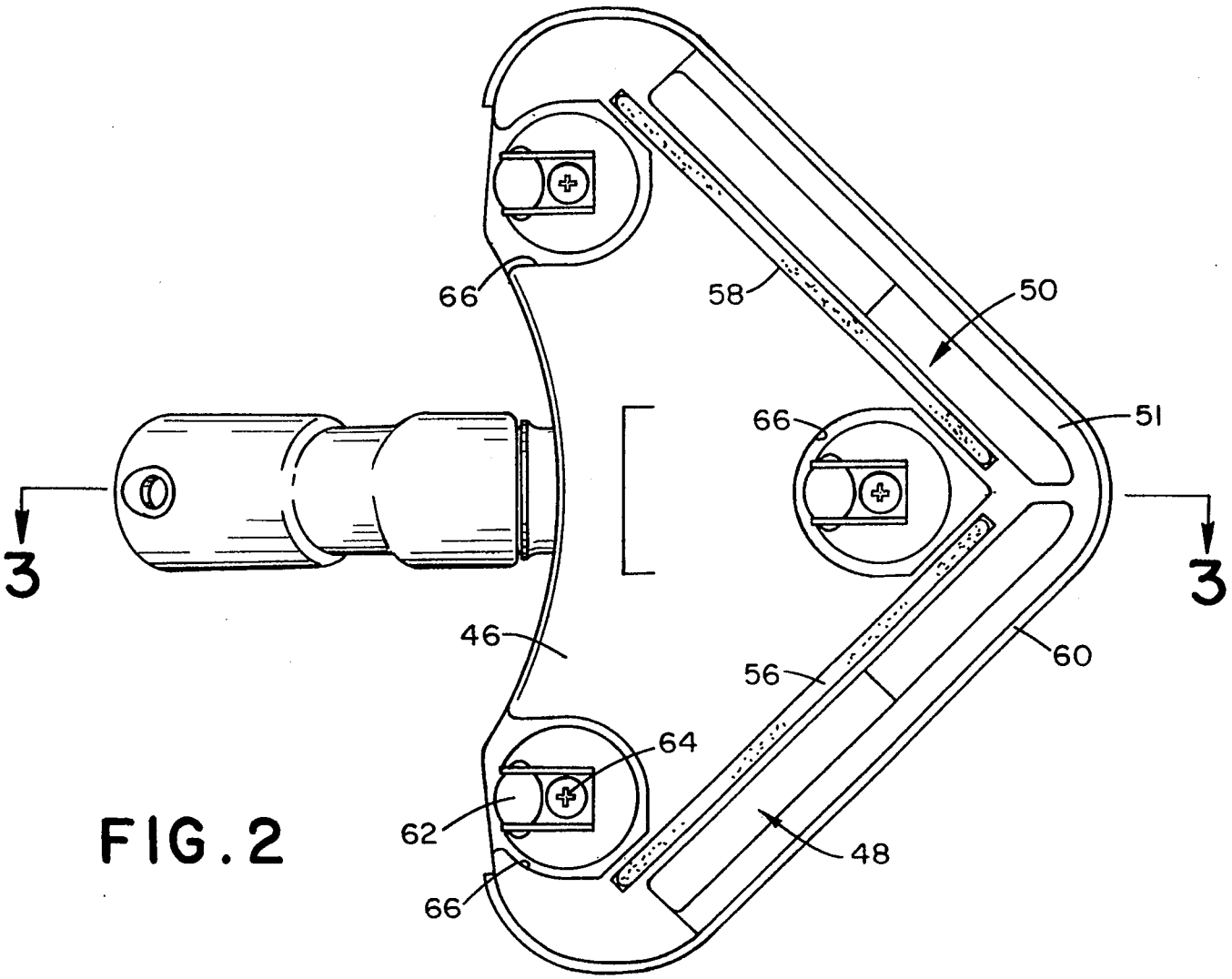
FIG. 2 is an enlarged bottom plan view of a nozzle of the vacuum cleaner of FIG. 1.
Figure 3:
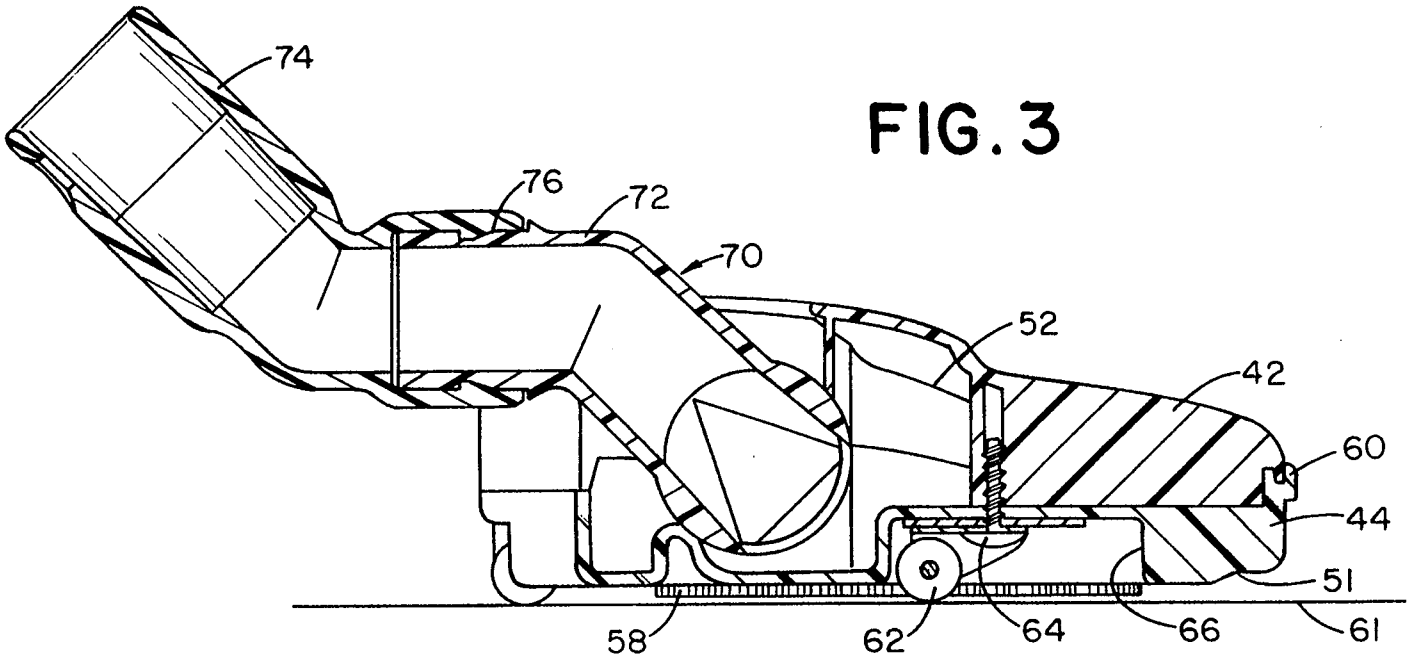
FIG. 3 is a side elevational view in cross section of the nozzle of FIG. 2.

FIG. 6 also shows a nozzle 40 that is secured to a lower end of the housing 10. With reference now again to FIG. 1, the nozzle comprises a cover 42 and a base 44. With reference to FIG. 2, the nozzle base includes a lower face 46. Located on the lower face are two suction openings 48 and 50 which together define a substantially V-shaped opening. As shown in FIG. 3, the lower face 46 has a stepped appearance adjacent the nozzle openings 48 and 50, the step being identified by the numeral 51. The stepped lower surface improves air flow into the unit, i.e. into the suction openings 48 and 50. In addition, the stepped opening helps reduce the effort necessary to push the vacuum cleaner over carpeted surfaces and the like.

Figure 5:
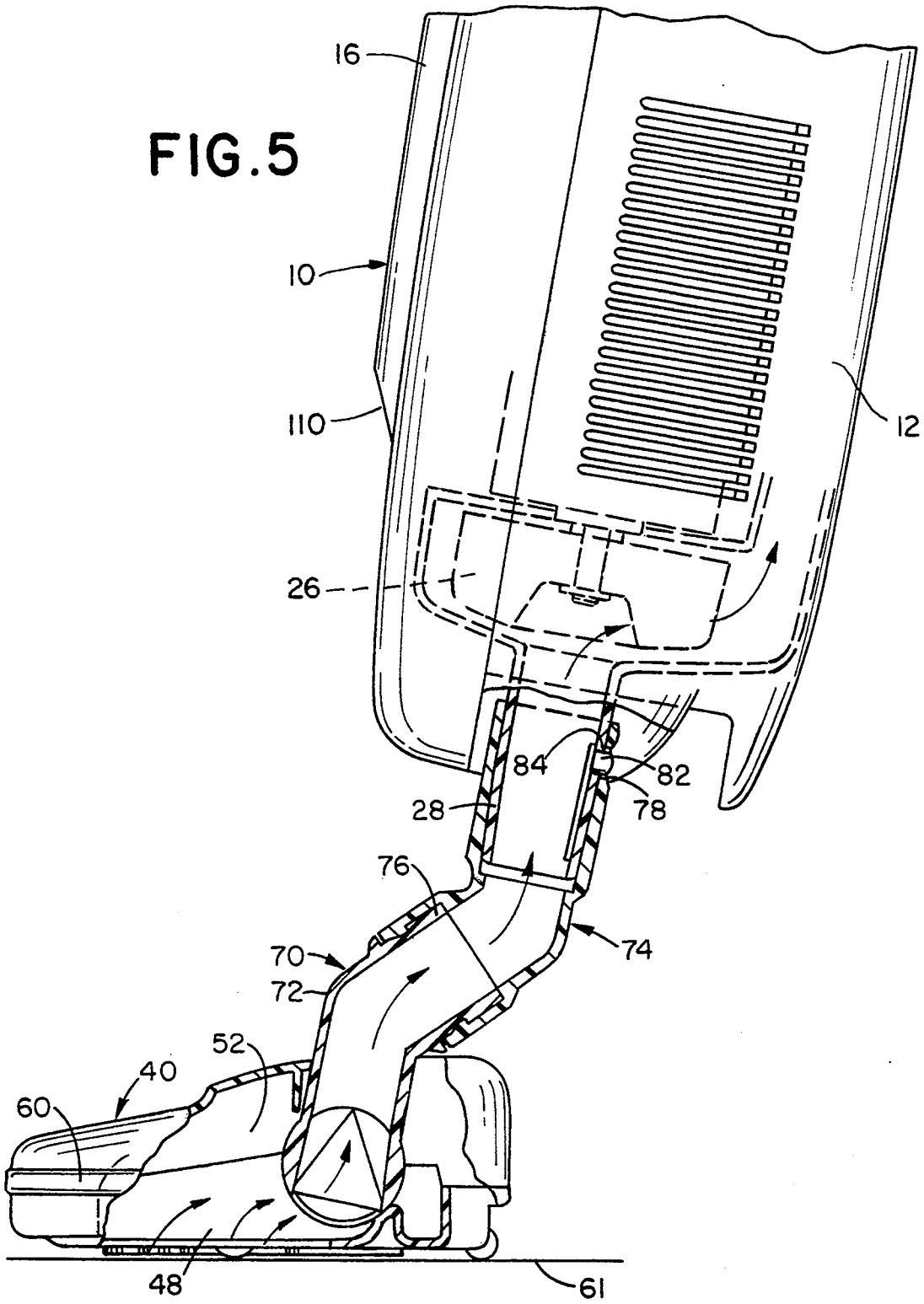
FIG. 5 is an enlarged side elevational view partially in cross section of a lower portion of the vacuum cleaner of FIG. 1 in an assembled condition.

A V-shaped suction opening is advantageous for vacuuming corners, baseboards and the like. Obviously, the V-shape of the suction opening on a V-shaped nozzle 40 enables one to successfully clean corners. In addition, the elongated suction opening provided along two side edges of the V-shaped nozzle 40 enables one to provide maximum cleaning efficiency adjacent baseboards and the like in a room. The openings communicate with a hollow interior 52 of the nozzle housing as illustrated in FIG. 5.

Figure 8:
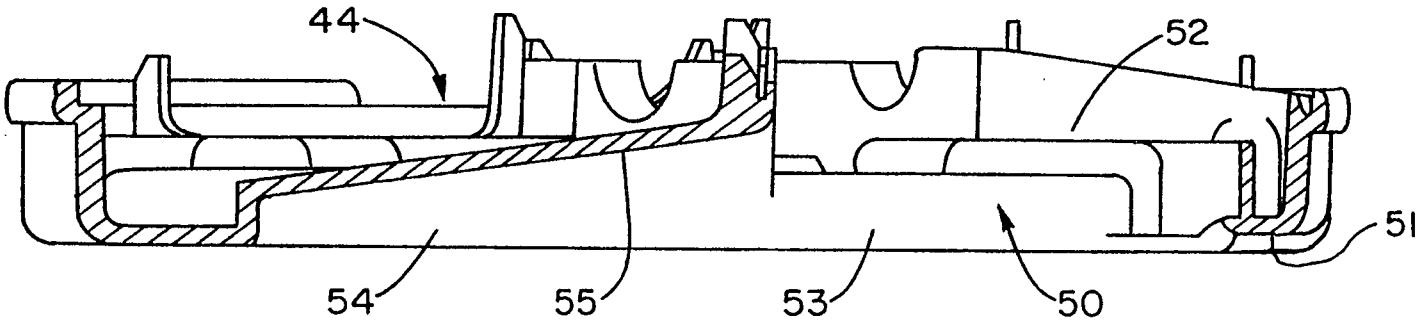

With reference now to FIG. 8, the suction openings, such as the suction opening 50 illustrated, each include first and second portions 53 and 54. The first portion 53 is directly open to the hollow interior 52 of the nozzle housing. In contrast, the second section 54 is defined by a sloping top wall 55 formed integral with the base 44.

The wall 55 slopes so as to provide a tapered passage. It is evident that the wall slope is such as to increase the depth of the section 54 towards the hollow interior 52. This construction has been found advantageous in that it promotes an increase in the velocity of the air which is sucked in from the section 54. This in turn promotes the cleaning efficiency of the nozzle.

Also provided on the lower face 46 are a pair of spaced brushes 56 and 58 that are located immediately behind the suction openings 48 and 50. These are useful to brush up dirt to be vacuumed. As shown in FIG. 5, an integral bumper 60 encircles the substantially triangular front face of the nozzle 40. The bumper may be part of nozzle base 44.

Rotatably supporting the nozzle on a subjacent surface such as the floor surface 61, illustrated, e.g., in FIG. 3, are a plurality of casters 62. As shown in FIG. 2, preferably three such casters are provided. These are preferably spaced in a substantially triangular or V-shaped arrangement on the lower face 46 of the nozzle 40. Securing each of the casters 62 to the nozzle 40 is a suitable fastener 64 as perhaps can be best seen in FIG. 3. It is preferred that the casters be located in indented sections 66 formed in the nozzle base lower face 46 so as to bring the suction openings 48 and 50 close to the subjacent surface 61 and to reduce the overall height of the nozzle so that it can glide under furniture. Therefore, three such indented sections 66 are provided one for each of the respective casters as can best be seen in FIG. 2. The casters 62 can be swiveling casters if desired, or they can be rigidly mounted. Swiveling casters may be advantageous for certain applications.

With reference again to FIG. 5, communicating with the hollow interior 52 of the nozzle 40 is a pivot assembly comprising a first, T-shaped, tube section 70 having a barrel 71 and a stem 72. The barrel is rotatably mounted in the nozzle 40 by a suitable first mounting means 73. Rotatably secured to the stem 72 of the first tube section 70 is a first end of a second, elbow-shaped, tube section 74 as by second mounting means 76. It is noted that the first and second mounting means 72 and 76 provide the housing 10 with 2 degrees of freedom in relation to the nozzle 40 because the first tube section 70 rotates in relation to the nozzle 40 in the plane of FIG. 5 and the second tube section 74 rotates around the first tube section 70.

Located near a second end of the second tube section 74 in a manner spaced from the second mounting means 76 is an aperture 78 extending through the wall of the tube section. The suction stub 28 extends out of the housing 10 and into the second tube section 74 adjacent the aperture 78. A fastening means comprising a resiliently mounted fastening pin 82 is secured to the suction stub 28. The fastening pin 82 extends through a suitable aperture 84 in the stub and the mating aperture 78 in the second tube section to selectively secure the second tube section 74 and hence the first tube section 70 and the nozzle 40 to the housing 10. It is noted that the first and second tube sections 70, 74 are permanently secured to each other in a rotatable manner and that the first tube section 70 is permanently secured in the nozzle 40 in a rotatable manner.

With reference again to FIG. 1, the vacuum cleaner A also includes a first handle 90 that is secured normally to an extender 92 which, in turn, is secured to a handle stub 94 of the housing back half 12.

Figure 4:
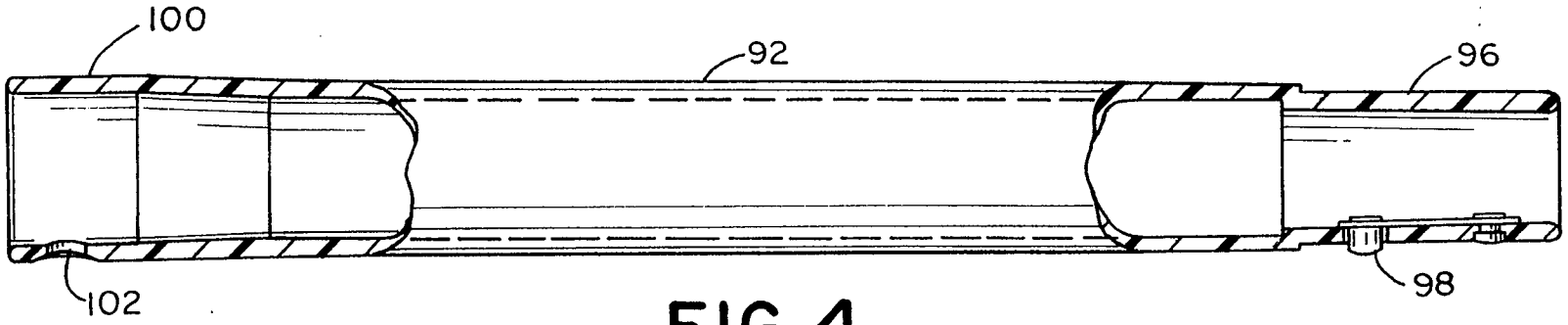
FIG. 4 is a side elevational view partially in cross section of a tubular handle extension of the vacuum cleaner of FIG. 1.

With reference now to FIG. 4, the extender 92 is hollow and includes a first end 96 in which is secured a resiliently biased fastening pin 98. The extender 92 also has a second end 100 which is provided with a transverse aperture 102. It is evident that the extender 92 is hollow so as to provide an air path. Also provided on the housing is a second handle or hand grip portion 110 which is located on the front housing half lower section or motor cover 16.

FIG. 6 illustrates an air vent opening 112 to allow cooling air to flow to the motor and exhaust air to flow therefrom. Also illustrated is an exhaust slot 114 through which filtered air from the filter bag 36 is exhausted.

In the normal configuration of the stick type vacuum cleaner, the extender 92 is positioned between the stub 94 and the first handle 90 as shown in FIG. 6. This allows the vacuum cleaner to be used for conventional on-the-floor cleaning. However, by removing the extender 92, the first handle 90 can be secured directly to the handle stub 94 as the stub is also provided with the same kind of resiliently biased fastening pin as is illustrated by the numeral 98 in FIG. 4 for the extender 92 and by the numeral 82 in FIG. 5 for the suction stub 28. When this is done, the extender 92 can be secured to the stub 28 on the lower end of the housing 10 as is illustrated in FIG. 7. Obviously, the extender 92 can only be secured to the suction stub 28 after the nozzle 40 is removed.

When this is accomplished, a suitable wand 120 can be secured to the first end 96 of the extender 92. This allows the user to employ the stick vacuum cleaner for above-the-floor cleaning such as the removal of cobwebs at ceiling corners or for the cleaning of curtains or the like. If desired, the wand 120 can be secured in a tool housing (not illustrated) provided on a rear side of the back housing half 12.

It should be appreciated that although the wand 120 is shown as being secured to the first end of the extender 92 in FIG. 7, the nozzle 40 could be secured in that position if desired. Also, any other conventional vacuum cleaner tool, such as a conventional suction brush (not illustrated), can be suitably secured to the extender 92.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

We claim:

1. A nozzle for a vacuum cleaner comprising:

a housing having a bottom surface and a top surface said housing having a substantially triangular shape;

a V-shaped suction opening located on said bottom surface of said housing, said V-shaped suction opening comprising a pair of linear openings;

a pair of rear casters located on said bottom surface of said housing one adjacent a respective rear corner of said triangular housing; and, means for pivotally mounting said pair of casters on said bottom surface of said housing whereby said casters are capable of rotating 360 degrees around a vertical axis passing through the nozzle so as to provide a swivelling action thereby enabling the nozzle to be used for cleaning along one of said linear openings and at an acute angle to another of said linear openings.

2. The nozzle of claim 1 wherein said casters are each located in a respective spaced indented section on said bottom surface.

3. The nozzle of claim 1 wherein said linear openings each include a first section which communicates with a hollow interior of said housing and a second section defined by an angled wall of said bottom surface of said housing.

4. The nozzle of claim 1 further comprising a stepped area located on said bottom surface of said housing in front of said suction opening.

5. A portable vacuum cleaner comprising:

a housing;

a substantially triangular nozzle which is selectively securable to said housing, said nozzle comprising:

a nozzle body having a bottom surface and a top surface, a V-shaped suction opening located on the bottom surface of said nozzle body, a plurality of casters located on said bottom surface of said housing, and means for pivotally mounting said casters whereby said casters are capable of rotating 360 degrees around a vertical axis passing through the nozzle, an air outlet member in fluid connection with said suction opening, wherein said air outlet member comprises:

a first tubular section pivotally mounted to said top surface of said nozzle body, and a second tubular section extending transversely to said first tubular section and rotatably mounted on a stem of said first section wherein said second tubular section can be selectively brought into fluid connection with said housing; and a motor mounted in said housing for effecting suction of air through said nozzle.

6. The vacuum cleaner of claim 5 further comprising a first handle detachably connected to said housing.

7. The vacuum cleaner of claim 6 further comprising an extension member detachably connected between said first handle to said housing.

8. The vacuum cleaner of claim 7 wherein said extension member comprises a tubular body which can be selectively detached from its location between said handle and said housing and secured between said nozzle and said housing.

9. The vacuum cleaner of claim 6 further comprising a second handle located on said housing in a spaced manner from said first handle.

10. The vacuum cleaner of claim 5 further comprising a plurality of casters located on said bottom surface of said nozzle housing.

11. The vacuum cleaner of claim 10 wherein three casters are located in a triangularly spaced manner on said nozzle body bottom surface.

12. The vacuum cleaner of claim 10 wherein said nozzle body bottom surface comprises a plurality of spaced indented sections and wherein each of said plurality of casters is located in a respective one of said indented sections to reduce an overall height of said nozzle.

13. The vacuum cleaner of claim 5 further comprising a means for detachably mounting said nozzle to said housing.

14. The vacuum cleaner of claim 5 wherein said first tubular section of said outlet member is T-shaped, has an inlet opening in a base thereof and an outlet opening in said stem.

15. A portable hand carried vacuum cleaner comprising:

a housing;

a nozzle selectively securable to said housing, said nozzle comprising:

a nozzle housing having a bottom surface and a top surface, with a hollow interior defined therebetween, a V-shaped suction opening located on said bottom surface of said nozzle housing wherein said V-shaped suction opening comprises a pair of linear openings each including a first section which communicates with said hollow interior of said housing and a second section defined by an angled wall of said nozzle bottom surface, wherein each said wall angles toward an adjacent linear opening to provide a concentrated suction configuration, an air outlet pivot assembly in fluid connection with said suction opening a suction motor mounted in said housing for effecting suction of air through said nozzle; and, a filter bag secured in said housing in a spaced relation from said motor and in fluid communication with said motor.

16. The vacuum cleaner of claim 15 further comprising a first handle detachably connected to said housing.

17. The vacuum cleaner of claim 16 further comprising an extension member detachably connected between said handle and said housing.

18. The vacuum cleaner of claim 17 wherein said extension member comprises a tubular body which can be selectively detached from its location between said handle and said housing and secured between said nozzle and said housing.

19. The vacuum cleaner of claim 16 further comprising a second handle spaced from said first handle.

20. The vacuum cleaner of claim 17 further comprising a stepped area located on said bottom surface of said housing in front of said suction opening.

21. A vacuum cleaner which is convertible between an upright vacuum cleaner and a portable hand carried vacuum cleaner, comprising:

a housing for vacuum components, said housing including first and second ends;

said vacuum components comprising:

a suction stub located at said first end of said housing, a motor and motor driven fan positioned in said housing for effecting a suction of air through said suction stub, and a filter means positioned in said housing for receiving air from said suction stub and arranged to remove and collect dirt from the air;

a first handle means mounted on said second end of said housing, said handle means comprising:

an extension pipe selectively mounted at a first end to said housing second end, and a handle member which is selectively mounted on a second end of said extension pipe, wherein said handle member can be mounted directly to said housing second end when said extension pipe is removed;

a second handle means located on said housing between said first and second ends thereof;

a nozzle selectively securable to said housing, said nozzle comprising:

a nozzle body having a bottom surface and a top surface;

a V-shaped suction opening located on a bottom surface of said nozzle body wherein said V-shaped suction opening comprises a pair of linear openings each including a first section which communicates with a hollow interior of said body and a second section defined by an angled wall of said nozzle body bottom surface, wherein each said wall tapers away from an adjacent linear opening to provide a concentrated suction configuration; and, an air outlet pivot assembly secured to said nozzle body and in fluid communication with said suction stub.

22. The vacuum cleaner of claim 21 wherein said filter means comprises a selectively removable and replaceable filter bag.

23. The vacuum cleaner of claim 21 further comprising a stepped area located on said bottom surface of said nozzle body in front of said suction opening.

24. The vacuum cleaner of claim 23 wherein said bottom surface comprises a plurality of spaced intended sections and wherein each of a plurality of casters is located in a respective one of said indented sections to reduce an overall height of said nozzle.

25. The vacuum cleaner of claim 21 wherein said air outlet pivot assembly comprises:

a first tubular section pivotally mounted on said nozzle housing; and, a second tubular section rotatably mounted on said first tubular section and extending substantially normal thereto.

26. The vacuum cleaner of claim 25 wherein said second tubular section comprises a T-shaped member having a stem rotatably mounted to said first tubular section and a barrel disposed at right angles to said stem, said barrel being rotatably mounted to said nozzle housing.

27. The vacuum cleaner of claim 21 further comprising a means for detachably mounting said nozzle to said housing.

* * * * *

UNITED STATES PATENT AND TRADEMARK OFFICE

CERTIFICATE OF CORRECTION

PATENT NO. : 5,347,679

DATED : September 20, 1994

INVENTOR(S) : Craig M. Saunders, et al.

It is certified that error appears in the above-indentified patent and that said Letters Patent is hereby corrected as shown below:

Claim 5, column 7, line 37, before "suction" insert --a--.

Claim 14, column 7, line 67, before "outlet" insert --air--.

Claim 15, column 8, line 9, after "surface" delete ",".

Claim 24, column 10, line 5, delete "intended" and substitute therefor --indented--.

Signed and Sealed this

Fourteenth Day of November, 1995

Bruce Lehman

*Attest:*

BRUCE LEHMAN

*Attesting Officer*

*Commissioner of Patents and Trademarks*